US006429606B1

(12) United States Patent
Aleardi et al.

(10) Patent No.: US 6,429,606 B1
(45) Date of Patent: Aug. 6, 2002

(54) ELECTRONIC GAS-LIGHTING DEVICE

(75) Inventors: Massimo Aleardi, Cassano Magnago; Raoul Bianchi, Villa Guardia, both of (IT)

(73) Assignee: ITW Industrial Components S.R.L., Milan (IT)

( * ) Notice: Subject to any disclaimer, the term of this patent is extended or adjusted under 35 U.S.C. 154(b) by 0 days.

(21) Appl. No.: 09/744,518

(22) PCT Filed: Jul. 28, 1999

(86) PCT No.: PCT/IT99/00246

§ 371 (c)(1),
(2), (4) Date: Mar. 28, 2001

(87) PCT Pub. No.: WO00/07217

PCT Pub. Date: Feb. 10, 2000

(30) Foreign Application Priority Data

Jul. 28, 1998 (IT) ..... TO98A0652

(51) Int. Cl.[7] ..... H05B 37/00; H05B 39/00
(52) U.S. Cl. ..... 315/363
(58) Field of Search ..... 315/7, 362, 363, 315/32, 169.3, 169.4, 291, 307; 431/7; 362/7; 361/730, 600, 679, 728, 736, 752; 313/11.5, 15, 34, 36, 44

(56) References Cited

U.S. PATENT DOCUMENTS 4,003,360 A * 1/1977 Branson ..... 126/39
4,430,989 A * 2/1984 Narang et al. ..... 126/273
5,057,348 A 10/1991 Drain et al. ..... 428/76
5,339,230 A * 8/1994 Devorris ..... 362/216
5,809,990 A * 9/1998 Jones et al. ..... 126/39
6,349,714 B1 * 2/2002 Hurley et al. ..... 126/39

FOREIGN PATENT DOCUMENTS

| | | |
|---|---|---|
| DE | 43 00 309 | 7/1994 |
| DE | 295 00 327 | 2/1995 |
| JP | 60 142117 | 7/1985 |

* cited by examiner

*Primary Examiner*—Don Wong
*Assistant Examiner*—Minh Dieu A
(74) *Attorney, Agent, or Firm*—Lowe Hauptman Gilman & Berner, LLP

(57) ABSTRACT

An electronic gas-lighting device having a casing defined by a cup-shaped body made of electrically insulating material is disclosed. An electronic high-voltage-pulse generator is housed in an inner cavity of the casing accessible through a mouth of the cup-shaped body. An output terminal is connected to the electronic pulse generator and housed through a respective seating duct formed integrally with a bottom wall of the cup-shaped body. A connecting board carrying an electric circuit and extending the full length of the cup-shaped body is positioned substantially closing the mouth, inside the cavity, and carries, on a first face facing the cavity, the electronic pulse generator connected mechanically and electrically to one another and to the board by the board itself and the circuit, so as to be housed in one continuous compartment defined by the inner cavity of the casing and by the connecting board, and so as to be embedded, together with the connecting board, in a matrix of insulating polymer resin which fills the whole of the cavity up to a point flush with the mouth of the cavity. The board has at least one through opening enabling the polymer resin to be poured into the casing with the board already in position.

12 Claims, 3 Drawing Sheets

FIG. 2
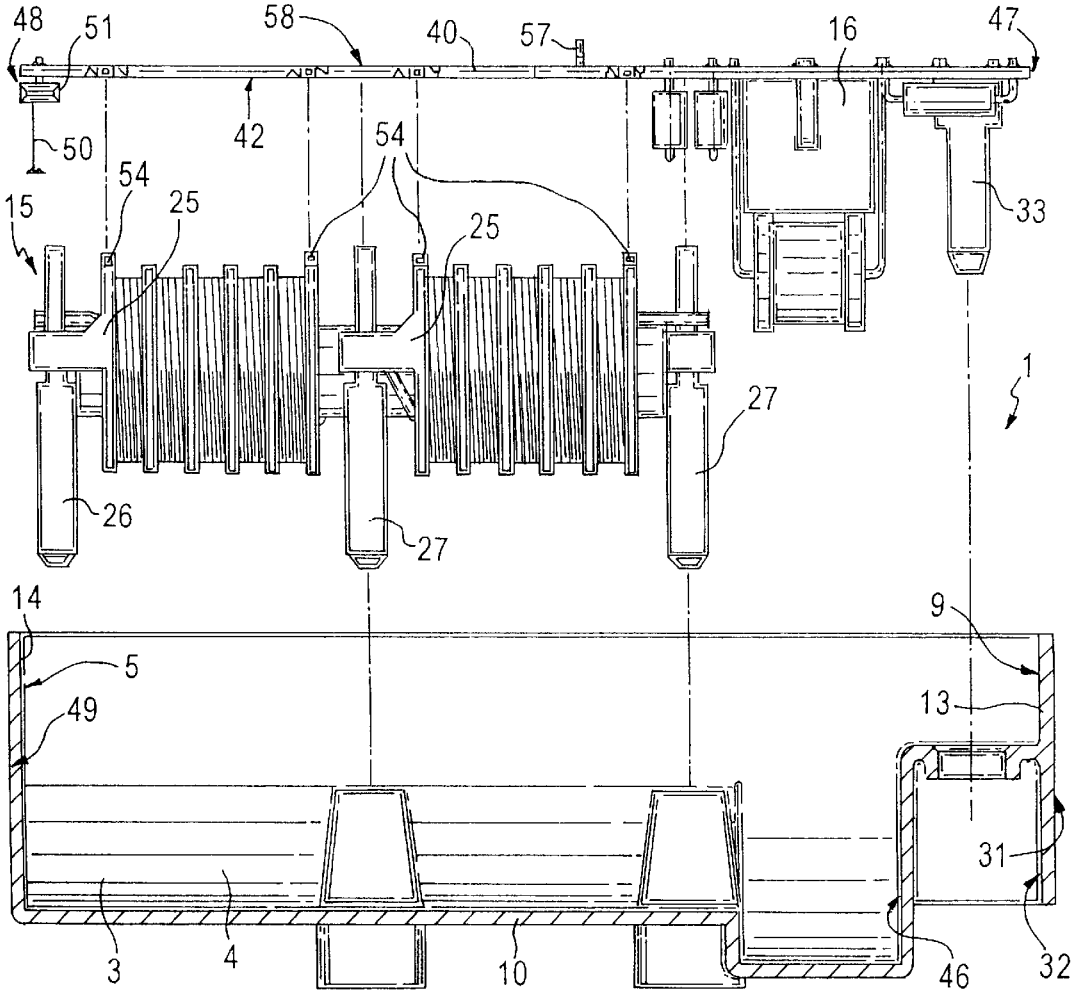
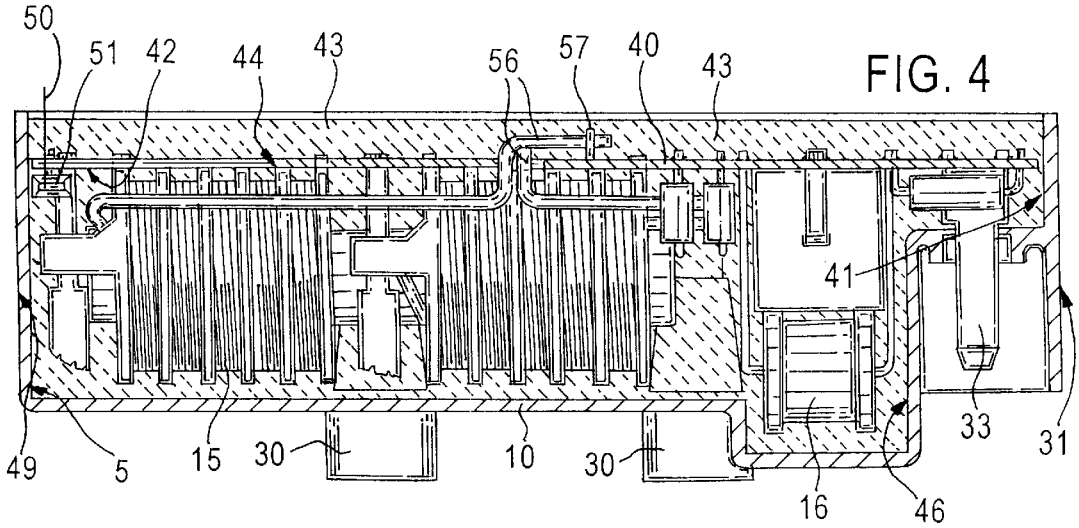
FIG. 4

ELECTRONIC GAS-LIGHTING DEVICE

TECHNICAL FIELD

The present invention relates to an electronic gas-lighting device which is cheap and easy to assemble and is fittable to a metal conducting body element of an electric household appliance, in particular a cooking range of a gas cooker, to light the burners.

BACKGROUND ART

Cooking ranges are known featuring integrated electric/electronic gas-lighters which are operated manually by means of pushbuttons to generate a spark by which to light one of the gas burners on the range. Known gas-lighters comprise a current-discharge generating circuit connected to one or more output terminals, each of which is connected by a conducting wire to an electrode located close to a burner to be lit: the electrodes are grounded by the range to which they are fitted. A spark is therefore generated between each electrode and each burner whenever a high-voltage current discharge is generated in the circuit.

In a first known type of gas-lighter, the various electric and electronic components of the circuit are housed in a cup-shaped body defining a casing made of nonconducting (typically polymer) material and divided by an inner wall into a first and second compartment from which the supply terminals and output terminals extend respectively; the output terminals are connected to respective secondary windings of a transformer in turn connected to a voltage discharger; the windings are housed in the first compartment of the casing and are embedded in an electrically insulting polymer resin from which the supply wires of the primary winding/s emerge; the wires are connected by means of connectors or soldered to the other circuit components which are normally carried on a printed circuit together with the components of an electronic filter, if provided, for filtering any electromagnetic noise produced when generating high-voltage pulses; and the printed circuit, together with the electronic components, is housed in the second compartment which is closed by a removable cover.

Devices of the first type therefore take a long time and are expensive to assemble, on account of the electric connections between the components in the two compartments and the cost of assembling the cover on the second compartment. What is more, in such devices, all the components of the pulse generating circuit (with the exception of the transformer) are located fairly close to one another and to the supply terminals.

In a second known type of gas-lighter, the generating circuit is embedded entirely inside a block of polymer resin which therefore substitutes for the casing. Nevertheless, this type of device is also expensive to assemble, on account of all the components and respective connecting wires having to be assembled with no support available and directly inside the molds into which the resin is poured. As such, devices of this sort are only feasible if cheap labour is available.

DISCLOSURE OF INVENTION

It is an object of the present invention to provide an electronic gas-lighting device of the type described, but designed to eliminate the aforementioned drawbacks, and which, in particular, is easy, fast and cheap to assemble, may even be assembled automatically, and enables the electronic components to be located a considerable distance from the supply terminals.

According to the present invention, there is provided an electronic gas-lighting device for spark-lighting at least one respective burner on a cooking range, the device comprising a casing defined by a cup-shaped body and made of electrically insulating material; electronic high-voltage-pulse generating means housed in an inner cavity of the casing, which cavity is accessible through a mouth of the cup-shaped body opposite and facing a bottom wall of the cup-shaped body; and, for each said burner catered to, at least one output terminal connected to said electronic high-voltage-pulse generating means and housed through a respective seating duct on the casing; characterized by also comprising a connecting board carrying an electric circuit and extending the full length of the cup-shaped body; said connecting board being positioned substantially closing said mouth but still inside said cavity, and carrying, on a first face facing said cavity, all said electronic high-voltage-pulse generating means connected mechanically and electrically to one another and to the connecting board by the connecting board itself and said circuit carried by the connecting board, so that said electronic high-voltage-pulse generating means are housed in one continuous compartment defined by said cavity of the casing and by the connecting board; said electronic high-voltage-pulse generating means being embedded, together with the connecting board, in a matrix of insulating polymer resin which fills the whole of said cavity up to a point substantially flush with said mouth; said connecting board having at least one through opening enabling said polymer resin to be poured into the casing with the connecting board already positioned closing the mouth.

More specifically, the seating duct on the casing projects outwards from said bottom wall of the cup-shaped body, is integral with the cup-shaped body, and is located on the opposite side to said mouth; and said electronic high-voltage-pulse generating means comprise at least one transformer, in turn comprising a secondary winding on an insulating tubular support, and a primary winding housed inside the insulating tubular support and coaxial with the secondary winding; each end of said secondary winding being connected to a respective said output terminal, which is defined by a flat blade connector defined by two opposite faces and carried mechanically by said insulating tubular support so that said faces are parallel to the axis of said windings.

The connecting board also preferably comprises at least one supply terminal at a first longitudinal end of the connecting board, located at a first end of said casing; and at least one ground contact at a second longitudinal end of the connecting board, opposite the first and located at a second end of said casing.

The gas-lighting device according to the invention is thus extremely compact as compared with similar known devices, while at the same time being cheap and easy to produce, easy to assemble, and easy to fit onto the cooking range, and provides for easily locating a grounded electric or electronic component as far away as possible from the end with the supply terminals. This is particularly useful, for example, in the event the device comprises an electronic noise filter, grounding of which is extremely cheap and easy and involves no complex assembly operations.

BRIEF DESCRIPTION OF DRAWINGS

A non-limiting embodiment of the present invention will be described by way of example with reference to the accompanying drawings, in which:

FIG. 2 shows a longitudinal lateral section of the FIG. 1 device partially assembled;

FIG. 4 shows a section along line IV—IV in FIG. 3;

BEST MODE FOR CARRYING OUT THE INVENTION

Figure 1:
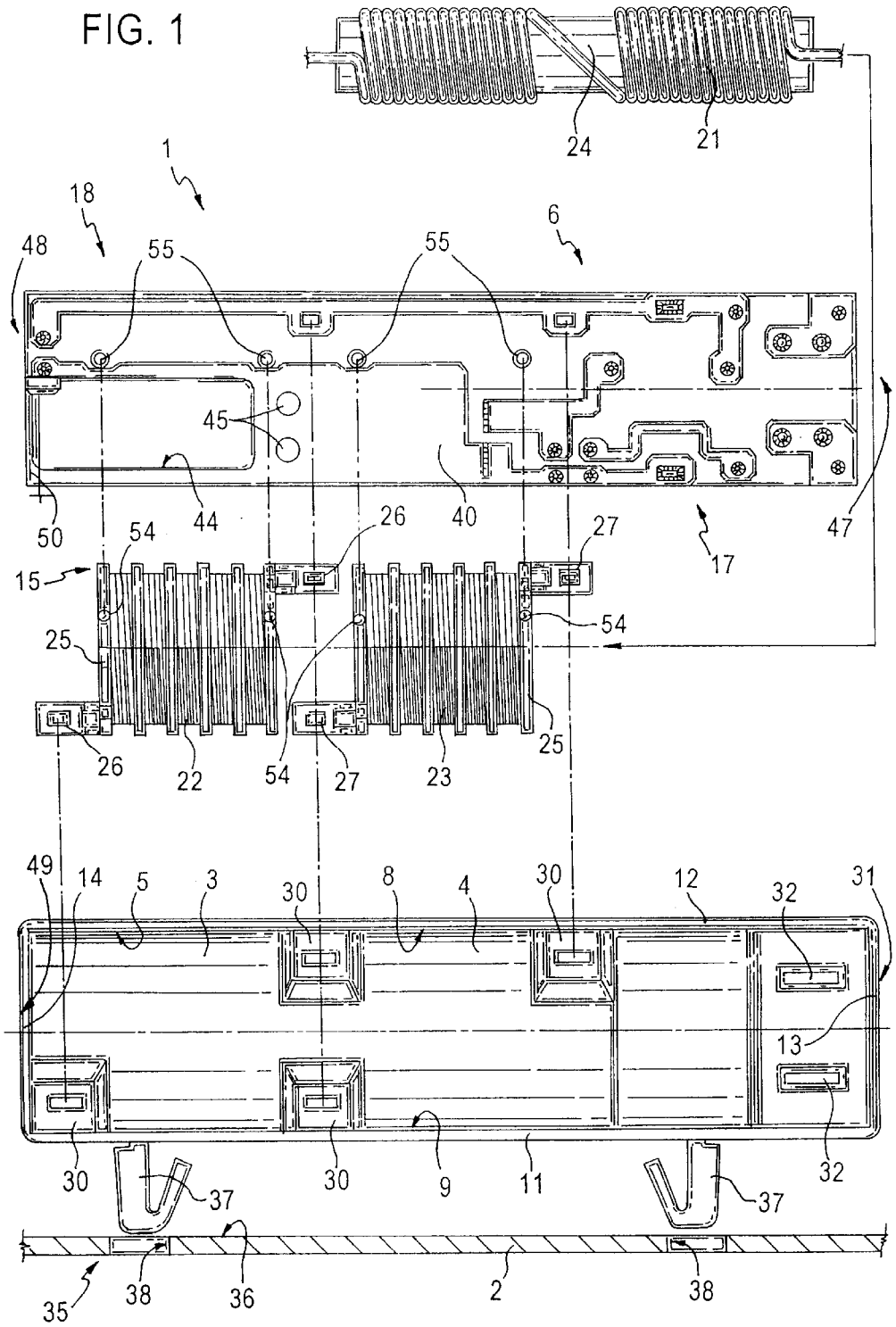
FIG. 1 shows an exploded top plan view of the gas-lighting device according to the invention.
Figure 3:
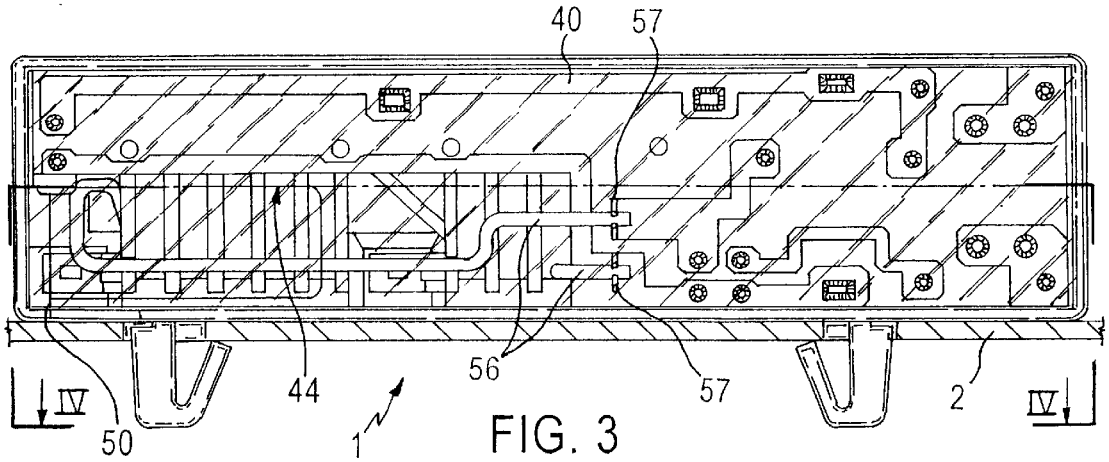
FIG. 3 shows a top plan view of the FIG. 1 device fully assembled.
Figure 6:
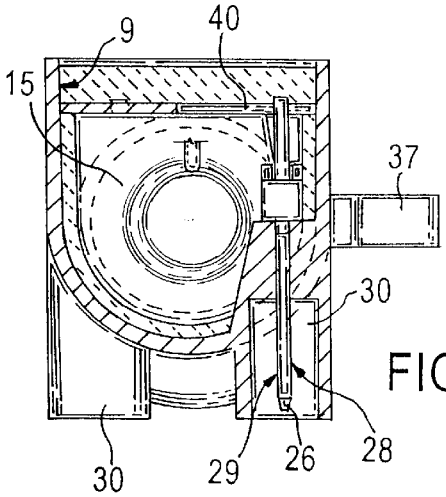
FIGS. 5, 6 and 7 show larger-scale schematic sections of respective details of the FIG. 1 device.
Figure 7:
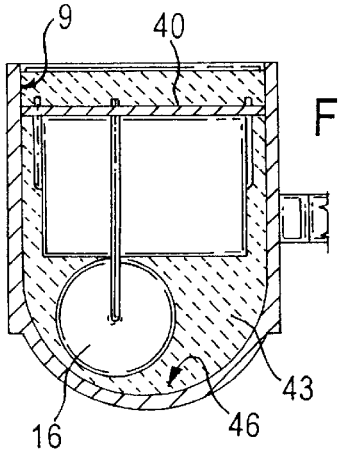
Figure 5:
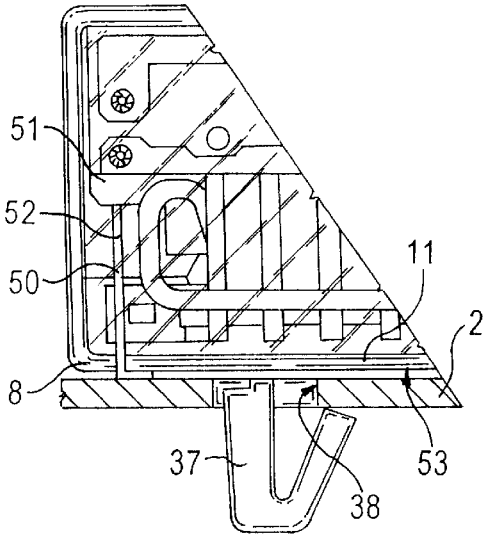

With reference to FIGS. 1 to 7, number 1 indicates as a whole an electronic gas-lighting device fittable to a known cooking range 2 shown only partly and schematically for the sake of simplicity.

Device 1 comprises a casing 3 made of electrically insulating material, defined by a cup-shaped body 4, and having an inner cavity 5 housing electronic high-voltage-pulse generating means 6; and edge 8 of cup-shaped body 4 defines a mouth 9 enabling access to cavity 5.

In the non-limiting example shown, cup-shaped casing 3 comprises a substantially rectangular bottom wall 10 opposite and facing mouth 9; and four lateral walls 11, 12, 13, 14 project perpendicularly from bottom wall 10, and define respective outer lateral faces of casing 3 and respective portions of edge 8.

Electronic high-voltage-pulse generating means 6 comprise a transformer 15 and a voltage discharger 16, both substantially known, and possibly a number of further known electric or electronic components—not described in detail for the sake of simplicity—defining as a whole an electric high-voltage-pulse generating circuit 17 (operating in known manner). Electric circuit 17 preferably also comprises electromagnetic-noise suppressing means 18, e.g. a substantially known electronic noise filter.

Transformer 15 is substantially cylindrical and comprises a primary winding 21 and two identical secondary windings 22, 23: primary winding 21 is wound about a cylindrical core 24 of magnetic material (typically ferrite); and secondary windings 22, 23 are coaxial and concentric with primary winding 21, are located radially outwards with respective to primary winding 21, and are separated longitudinally from each other. In particular, secondary windings 22, 23 are wound about respective substantially cylindrical insulating tubular supports 25 made, for example, of insulating polymer material; and primary winding 21 is inserted coaxially inside tubular supports 25. According to a known construction solution, the turns of secondary windings 22, 23 are housed in a number of annular seats defined by respective radial flanges on the outer lateral surfaces of tubular supports 25, so that tubular supports 25 mechanically support both respective secondary windings 22, 23 and the primary winding 21 inserted inside the tubular supports.

Secondary windings 22, 23 are connected, at respective opposite ends, to respective pairs of output terminals 25, 27, each of which, in use, caters to a corresponding burner on cooking range 2. In particular, output terminals 26, 27 are defined by respective flat blade connectors made, for example, of conducting metal and each defined by two opposite faces 28, 29. According to the invention, connectors 26, 27 are carried mechanically by tubular supports 25 so that faces 28, 29 are parallel to the axis of windings 21, 22, 23.

Connectors 26, 27 are housed through respective seating ducts 30 defined by respective tubular projections formed integrally with casing 3 and projecting perpendicularly outwards from bottom wall 10, on the opposite side to mouth 9. Close to a first longitudinal end 31 of casing 3, bottom wall 10 also has a further two seating ducts 32 for respective supply terminals 33 of electric circuit 17, which may also advantageously be defined by flat blade connectors like output terminals 26, 27.

Device 1 also comprises fast-fit means 35 for fitment to a metal conducting body element of an electric household appliance, in particular to a conducting surface 36 of cooking range 2. In the non-limiting example shown in FIGS. 1 to 7, fast-fit means 35 comprise two click-on connecting elements 37 which are formed integrally with casing 3, project outwards from lateral wall 11 of casing 3, extend substantially parallel to bottom wall 10, and engage respective retaining seats 38 formed in conducting surface 36 of cooking range 2.

According to the invention, electric circuit 17 of device 1 is carried by a connecting board 40 extending the full length of cup-shaped body 4 defining casing 3; connecting board 40 is positioned substantially closing mouth 9 of cavity 5, but still inside cavity 5, and defines, together with cavity 5, a continuous compartment 41; connecting board 40 carries, on a first face 42 facing cavity 5, electronic high-voltage-pulse generating means 6 which are therefore all housed inside continuous compartment 41; and electronic high-voltage-pulse generating means 6 are connected mechanically and electrically to one another and to connecting board 40 by means of connecting board 40 itself and electric circuit 17. In the non-limiting example shown in FIGS. 1 to 7, connecting board 40 is a flat rectangular board inserted inside cavity 5 of casing 3, parallel to bottom wall 10 of casing 3, and with first face 42 facing bottom wall 10.

Electronic high-voltage-pulse generating means 6 and connecting board 40 are embedded in a matrix 43 of insulating polymer resin which fills the whole of cavity 5 up to a point substantially flush with mouth 9. To enable the polymer resin to be poured into cavity 5 with connecting board 40 already positioned closing mouth 9, connecting board 40 has a through opening 44 of any shape, and a number of through holes 45 located away from through opening 44: through opening 44 therefore enables the polymer resin to be poured into cavity 5 through connecting board 40, while through holes 45 provide for expelling air from continuous compartment 41 as the polymer resin is being poured.

Electronic high-voltage-pulse generating means 6 are therefore housed inside continuous compartment 41 and embedded in polymer resin matrix 43. In particular, transformer 15 and voltage discharger 16 are therefore also located on the same side of connecting board 40, between connecting board 40 and bottom wall 10 of casing 3; and voltage discharger 16 projects perpendicularly from first face 42 of connecting board 40 towards bottom wall 10, and is partially housed in a respective semicylindrical seat 46 projecting from bottom wall 10, on the outside of casing 3, and defining a semicylindrical projection on bottom wall 10.

Supply terminals 33 of electric circuit 17 are located at a first longitudinal end 47 of connecting board 40, located at longitudinal end 31 of casing 3; connecting board 40 also comprises a ground contact 50 at a second longitudinal end 48 of the connecting board, opposite first longitudinal end 47 and located at a longitudinal end 49 of casing 3; transformer 15 is located close to longitudinal end 48 of connecting board 40 having ground contact 50; and voltage discharger 16 is located close to longitudinal end 47 of connecting board 40, between transformer 15 and supply terminals 33, and substantially alongside supply terminals 33.

Ground contact 50 extends through polymer resin matrix 43, on the opposite side to bottom wall 10. In the preferred embodiment shown, ground contact 50 is connected to a generic component 51 of electric circuit 17, which in turn is connected mechanically and electrically to face 42 of connecting board 40. Ground contact 50 extends, through through opening 44 in connecting board 40, astride edge 8 defining mouth 9, and more specifically astride the portion of edge 8 defined by lateral wall 11 of casing 3. In particular, ground contact 50 has an end portion 52 projecting outside continuous compartment 41 and outside matrix 43, and which is positioned parallel to an outer lateral surface 53 of casing 3, for example, an outer surface of lateral wall 11, so that end portion 52 of ground contact 50 is available externally on lateral wall 11 of casing 3, on the same side as click-on connecting elements 37, and is gripped, in use, between casing 3 and conducting surface 36 of cooking range 2 to rapidly ground connecting board 40, and in particular component 51, as shown schematically in FIG. 5 (in which the components shown are not accurately proportioned).

Ground contact 50 may, of course, be connected to conducting surface 36 of cooking range 2 otherwise than as described above, e.g. using a connecting element of any known type fitted to the free end of end portion 52 and which clicks inside a respective seat on cooking range 2.

Component 51 of electric circuit 17, to which ground contact 50 is connected, is advantageously a component of electronic noise filter 18, e.g. a capacitor (which, according to one known solution, needs grounding). By virtue of the conformation of device 1 according to the invention, ground contact 50 is located as far as possible from supply terminals 33.

Moreover, tubular supports 25 of transformer 15, which mechanically support both secondary windings 22, 23 and primary winding 21, are preferably connected integrally and removably to connecting board 40, e.g. by means of a number of fastening pins 54 inserted inside respective holes 55 on connecting board 40. The opposite ends of primary winding 21 are also connected electrically to electric circuit 17, in any known manner, by means of a pair of insulated electric conductors 56 in turn connected electrically and mechanically to respective connecting terminals 57 on connecting board 40.

For example, insulated electric conductors 56 are conducting wires surrounded with insulating material, and connecting terminals 57 are defined by respective blade contacts projecting from a second face 58, opposite first face 42, of connecting board 40 and having respective V-shaped notches with cutting edges: when the respective ends of insulated electric conductors 56 are pressed into the V-shaped notches of the blade contacts, the cutting edges of the notches cut the ends partly and deep enough to expose the respective conducting wires inside.

Insulated electric conductors 56 may, of course, be connected to connecting terminals 57 in any other known manner, e.g. by soldering.

Clearly, further changes may be made to the device as described above without, however, departing from the scope of the accompanying Claims.

What is claimed is:

1. An electronic gas-lighting device for spark-lighting at least one respective burner on a cooking range, the device comprising a casing defined by a cup-shaped body and made of electrically insulating material; electronic high-voltage-pulse generating means housed in an inner cavity of the casing, which cavity is accessible through a mouth of the cup-shaped body opposite and facing a bottom wall of the cup-shaped body; and, for each said burner catered to, at least one output terminal connected to said electronic high-voltage-pulse generating means and housed through a respective seating duct on the casing; characterized by also comprising a connecting board carrying an electric circuit and extending the full length of the cup-shaped body; said connecting board being positioned substantially closing said mouth but still inside said cavity, and carrying, on a first face facing said cavity, said electronic high-voltage-pulse generating means connected mechanically and electrically to the connecting board and said circuit carried by the connecting board, so that said electronic high-voltage-pulse generating means is housed in one continuous compartment defined by said cavity of the casing and by the connecting board; said electronic high-voltage-pulse generating means being embedded, together with the connecting board, in a matrix of insulating polymer resin which fills the whole of said cavity up to a point substantially flush with said mouth; said connecting board having at least one through opening enabling said polymer resin to be poured into the casing with the connecting board already positioned closing the mouth.

2. A device as claimed in claim 1, characterized in that said seating duct on the casing projects outwards from said bottom wall of the cup-shaped body, is integral with the cup-shaped body, and is located on the opposite side to said mouth; and in that said electronic high-voltage-pulse generating means comprise at least one transformer, in turn comprising a secondary winding on an insulating tubular support, and a primary winding housed inside the insulating tubular support and coaxial with the secondary winding; each end of said secondary winding being connected to a respective said output terminal, which is defined by a flat blade connector defined by two opposite faces and carried mechanically by said insulating tubular support so that said faces are parallel to the axis of said windings.

3. A device as claimed in claim 1, characterized in that said connecting board comprises at least one supply terminal at a first longitudinal end of the connecting board, located at a first end of said casing; an at least one ground contact at a second longitudinal end of the connecting board, opposite the first and located at a second end of the said casing.

4. A device as claimed in claim 3, characterized in that said ground contact extends through said matrix of polymer resin, on the opposite side to said bottom wall, and has an end portion projecting outside said continuous compartment and outside said matrix of polymer resin; said end portion of said ground contact being positioned parallel to an outer lateral surface of said casing.

5. A device as claimed in claim 4, characterized in that said ground contact extends through said through opening in the connecting board and astride an edge of said mouth.

6. A device as claimed in claim 4 characterized by also comprising fast-fit means for fitment to a metal conducting body element of an electric household appliance, in particular to a cooking range of a gas cooker; said fast-fit means comprising respective click-on connecting means which are formed integrally with said casing, project from a lateral wall of said cup-shaped body defining the casing, and extend substantially parallel to said bottom wall; said end portion of the ground contact being available externally on said lateral wall of the casing, on the same side as and between said click-on connecting means, and being gripped, in use, between said casing and a conducting surface of said metal conducting body element of an electric household appliance to rapidly ground the connecting board.

7. A device as claimed claim 1 characterized in that said connecting board comprises, in combination, at least said through opening, and at least one through hole located apart from said through opening and by which air is expelled from said continuous compartment as the continuous compartment is filled with said resin to form said matrix.

8. A device as claimed in claim 2, characterized in that said electronic high-voltage-pulse generating means also comprise a voltage discharger which projects perpendicularly from said connecting board towards said bottom wall, and is housed partially in a semicylindrical seat defining a semicylindrical projection on the outside of said bottom wall.

9. A device as claimed in claim 3, characterized in that said electronic high-voltage-pulse generating means comprise an electronic electromagnetic-noise filter; said ground contact being connected to a component of said electronic electromagnetic-noise filter connected mechanically and electrically to said connecting board.

10. A device as claimed in claim 2, characterized in that said insulating tubular support mechanically supports both the primary and secondary windings, and is connected integrally and removably to said connecting board by at least one respective fastening pin; the opposite ends of the primary winding being connected electrically to said electric circuit on the connecting board by two insulated electric conductors connected electrically and mechanically to respective connecting terminals on the connecting board.

11. A device as claimed in claim 10, characterized in that said insulated electric conductors are soldered to said connecting terminals.

12. A device as claimed in claim 10, characterized in that said terminals to which said insulated electric conductors are connected are defined by respective blade contacts projecting from said first face of the connecting board and having respective V-shaped notches into which respective ends of the insulated electric conductors are pressed so as to be cut partially by respective cutting edges of the notches to a depth sufficient to expose respective conducting wires.

* * * * *